US010598456B1

(12) United States Patent
Tal et al.

(10) Patent No.: US 10,598,456 B1
(45) Date of Patent: Mar. 24, 2020

(54) MAGAZINE LOCKABLE LOADER WITH SELF-RISING PLUNGER

(71) Applicant: Guy Tal, Rosh Ha'Ayin (IL)

(72) Inventors: Ran Tal, Tel Aviv (IL); Guy Tal, Rosh Ha'Ayin (IL)

(73) Assignee: Maglula, Ltd., Rosh Ha'Ayin (IL)

( * ) Notice: Subject to any disclaimer, the term of this patent is extended or adjusted under 35 U.S.C. 154(b) by 0 days.

(21) Appl. No.: 16/586,936

(22) Filed: Sep. 28, 2019

Related U.S. Application Data

(60) Provisional application No. 62/739,974, filed on Oct. 2, 2018.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84; F41A 9/82
USPC ..... 42/87, 88
See application file for complete search history.

(56) References Cited

U.S. PATENT DOCUMENTS 4,464,855 A 8/1984 Musgrave
4,570,371 A * 2/1986 Mears ..... F41A 9/83 42/87
4,689,909 A 9/1987 Howard
4,719,715 A 1/1988 Howard
4,739,572 A 4/1988 Brandenburg
4,827,651 A 5/1989 Conkey
4,829,693 A 5/1989 Holmes
4,888,902 A 12/1989 Carter
4,939,862 A 7/1990 Brandenburg
4,970,820 A 11/1990 Miller
4,993,180 A 2/1991 Upchurch
5,249,386 A 10/1993 Switzer
5,301,449 A 4/1994 Jackson
5,355,606 A 10/1994 Origoni
5,377,436 A * 1/1995 Switzer ..... F41A 9/83 42/87
6,178,683 B1 1/2001 Williams
6,189,254 B1 2/2001 Steitz
6,219,953 B1 4/2001 Bentley
6,286,243 B1 9/2001 Hinton
(Continued)

OTHER PUBLICATIONS

Champion 10/22 Mag Loader—http://www.championtarget.com/shooting_gear/magazines_loaders/loaders.aspx, 2019.
(Continued)

*Primary Examiner* — Reginald S Tillman, Jr.
(74) *Attorney, Agent, or Firm* — David Pressman

(57) ABSTRACT

A loader (10) facilitates loading loose rounds into a firearm magazine (60). It comprises a body (12) that fits on and is locked to the magazine using a locker (40). A spring-loaded press (30) with a plunger (34) is coupled to the body and is tiltable from above to between the magazine's lips (64). To load a round, the user fits the loader onto and locks it to the magazine and forces the spring-loaded press down so the plunger pushes the topmost round and/or follower down enough to insert a new round, case first, until it meets the plunger. Then the user reduces force on the press to allow the plunger to be lifted up so that the plunger is cleared from the magazine, whereupon the user can nudge the partially inserted round rearwardly to its final position in the magazine.

20 Claims, 5 Drawing Sheets

(56) References Cited

U.S. PATENT DOCUMENTS

| | | | | |
|---|---|---|---|---|
| D477,047 | S | 7/2003 | Springer | |
| 6,817,134 | B2 * | 11/2004 | Newman | F41A 9/83 42/87 |
| D503,960 | S | 4/2005 | Robert | |
| 7,257,919 | B1 | 8/2007 | Farley | |
| 7,383,657 | B2 | 5/2008 | Pikielny | |
| 7,487,613 | B2 | 2/2009 | Taylor | |
| 7,637,048 | B2 | 12/2009 | Tal | |
| 8,065,830 | B2 | 11/2011 | Twardy | |
| 8,356,441 | B2 | 1/2013 | Meinel | |
| 9,212,859 | B1 | 12/2015 | Tal | |
| 9,618,286 | B1 | 4/2017 | Plate | |
| 2003/0046854 | A1 | 3/2003 | Urchek | |
| 2013/0061505 | A1 | 3/2013 | Faifer | |
| 2013/0232843 | A1 * | 9/2013 | Bajuelo | F41A 9/83 42/87 |
| 2014/0033592 | A1 | 2/2014 | Fiorucci | |
| 2015/0316341 | A1 * | 11/2015 | Aguilar | F41A 9/83 42/87 |
| 2017/0051992 | A1 | 2/2017 | Cottrell | |
| 2017/0067707 | A1 | 3/2017 | Zivic | |
| 2018/0058785 | A1 * | 3/2018 | Hefer | F41A 9/83 |

OTHER PUBLICATIONS

McFadden Lightnin' Grip 10/22 loader—http://www.mcfaden.com/product-p/lightnin-grip.htm, 2019.

Butler Creek Hot Lips 10/22 Loader—https://www.butlercreek.com/magazine-loaders/hot-lipssteel-lips-loader, 2019.

Ram-Line / Champion 10/22 Loader—http://www.ramlinestocks.com/images/sr_40430.jpg.

https://www.speedbeez.com/product/glock-9mm-magazine-loader-lever-loader/ (Includes Movie clip: https://www.youtube.com/watch?v=P43nH9rgBu4).

Archangel Manufacturing/Promag Industries, South Gate, CA, USA, "Archangel 10/22 Magazine Loader AA115". https://www.archangelmanufacturing.com/aa1151022loader.

Speedbeez https://www.speedbeez.com/product-category/mag-loaders/22lr-long-guns/mag-loaders-ruger-10-22/.

ADCOSUPERTHUMBhttp://www.adcosuperthumb.com/st4-extended-magazine-loader/.

* cited by examiner

MAGAZINE LOCKABLE LOADER WITH SELF-RISING PLUNGER

CROSS-REFERENCE TO PENDING APPLICATIONS

This patent issued from an application that claims priority of Provisional Application Ser. No. 62/739,974, Filed 2018 Oct. 2.

BACKGROUND

Prior Art

Small firearms, including pistols, assault rifles, and submachine guns, utilize and fire rounds (also known as cartridges and ammunition). Each round is substantially elongated and comprises a deep cylindrical cuplike case (also known as a shell, casing, and sometimes also a cartridge), usually of brass, which is filled with an explosive propellant. At its rear or closed end, the case has a rim or flange containing a primer; the front and opposite end of the case is open. A bullet, slug, or head, usually of lead (optionally jacketed) is partially inserted into the open or front end of the case, whereafter the case is crimped onto the bullet to secure it in the case.

A magazine or clip usually holds a number of rounds and feeds them into the firearm. Detachable magazines have become dominant throughout the world. The term 'magazine' is broad, encompassing several geometric variations, including box, curved, and drum magazines. Most detachable boxed and curved magazines are similar, varying in form and structure, rather than in their general principles of operation. Drum magazine usually store rounds differently than boxed and curved magazines. All magazines have a catch, usually a hole, dent, or protrusion, to enable it to be locked and retained on a designated firearm.

Non-drum magazines usually take the form of an elongated container having a generally rectangular cross-section, which can be removably attached to the magazine well of the firearm. They are commonly made of aluminum alloys, plastic, steel, or a combination. They are usually closed on five sides and open on a sixth, upwardly facing, top, side, or end, and are substantially hollow. The top or open side has a rectangular end and includes two round-retaining members, known as feed lips. These magazines have an internal spring which urges a follower or pusher (a shaped piece of plastic or metal) straight up toward the open side. The follower in turn urges the rounds as a group up against the lips. The lips of magazines act as a stop for the rounds so that they are not expelled from the magazine.

Some magazines, like the popular .22LR (Long Rifle) 'BX' magazines made by Sturm Ruger and Co. (Ruger), of Southport, Conn., and sold under Ruger's trademark 10/22, have an internal rotatable drum which holds rounds in 1, 5, or 10 elongated indents or grooves in the drum. The rounds are arranged in equally spaced grooves parallel each other along the circumference of the drum, bullets pointing forward. The drum feeds each round toward the lips by force from an internal coiled spring. When a top-most round is ejected or unloaded from the magazine, the drum turns a notch and feeds a new round between the lips.

In non-drum magazines, rounds are stacked or oriented in the magazine such that the longitudinal axes of the rounds are substantially parallel, and perpendicular to the direction of travel of the spring and follower. Adjoining rounds are oriented side-by-side, i.e., the bullets of adjacent rounds are next to each other, as are the cases. The rounds are usually stacked in the magazine, either in a single column (also called single-stacked), like other popular .22LR (Long Rifle) 'BX-25' magazines made by Ruger, or in a staggered, zigzag, column fashion (also called double-stacked or high-capacity magazines).

Commonly, in pistol magazines, whether staggered or not, and in most .22LR and similar small caliber rifle magazines and drum magazines, such as Ruger's 10/22 BX magazines, the space between the retaining lips is smaller than the case diameter of the rounds so that the two lips (rather than a single lip) of the magazine hold the topmost round.

Prior to use, a firearm magazine must be loaded (charged or filled). When a magazine is being loaded, it is necessary to depress the follower and all previously loaded rounds to provide space below the lips so that each additional round can be inserted. Each time another round is loaded the spring is further compressed, requiring increased manual force by the user. I.e., when rounds are loaded with one's bare hands, the press-down force required increases as more rounds are loaded one at a time against the spring's force (which forces the rounds toward the lips). Some drum magazines use a flat coiled spring which presents constant force to the loader rather than increasing force, yet loading effort remains.

When a user loads a large number of rounds or many magazines the force required will actually cause finger pain, which will increase with the number of rounds loaded. Loading a magazine of the type having two lips which retain a single top round begins with the user placing a new round, case first, on top of the follower, in front of the lips. Then the user uses a thumb to force down the new round and the follower below it into the magazine to create sufficient space below the lips to slide the new round rearward over the follower and below the lips to be retained by them.

To load subsequent rounds, this procedure repeats, except that the user places each new round to be loaded on top of the last-loaded or top round and forces down the new round, the previously loaded round(s), and the follower, to make space below the lips to slide the new round rearward over the last-loaded round and below the lips.

The user repeats this procedure until the magazine is full.

Hereafter the term 'magazine' will mean box-type magazines and drum magazines which have two lips retain the topmost round.

To increase loading speed and decrease finger pain associated with loading magazines, numerous magazine loaders were developed. These are generally divided into two main groups: loaders having no moving mechanism, which are the simplest and cheapest and least comfortable to use, and loaders having some moving mechanism, which are usually superior.

Some prior art loaders which have no moving mechanism are shown in the following table:

TABLE 1

U.S. patents - Loaders With No Moving Mechanism

| Pat. or Pub. No. | Issue or Pub. Date | Patentee or Applicant |
|---|---|---|
| 4,827,651 | 1989 May 9 | Conkey |
| 4,829,693 | 1989 May 16 | Holmes |
| 4,993,180 | 1991 Feb. 19 | Upchurch |
| 6,189,254 | 2001 Feb. 20 | Steitz |
| 6,219,953 | 2001 Apr. 24 | Bentley |
| 6,286,243 | 2001 Sep.11 | Hinton |
| D477,047 | 2003 Jul. 8 | Springer |

TABLE 1-continued

| U.S. patents - Loaders With No Moving Mechanism | | |
|---|---|---|
| Pat. or Pub. No. | Issue or Pub. Date | Patentee or Applicant |
| 7,257,919 | 2007 Aug. 21 | Farley |
| 7,487,613 | 2009 Feb. 10 | Taylor |
| 8,065,830 | 2011 Nov. 29 | Twardy |

The above loaders are cumbersome, slow, and least comfortable to use.

Loaders with No Moving Mechanism—Non-Patent Literature

Mag-Pal magazine loaders (manufacturer unknown) are two single-part loaders having no moving mechanism; one is designed to load Ruger's 10/22 factory magazines and the other is designed to load aftermarket 10/22 magazines. Both are not lockable to the magazine. The loader for Ruger mags has an angled round plunger, the other one has a straight round plunger. These loaders are pushed down on top of each respective magazine to have the plunger force a top-most round into the magazine to provide a vacant space below the lips of the magazine. The user needs to lift up the loader for each inserted round. These loaders have no self-rising plunger, they are flimsy when on the magazine and awkward to operate. Both loaders can be seen at: https://www.speedbeez.com/product-category/mag-loaders/22lr-long-guns/mag-loaders-ruger-10-22/

ADCO of Woburn Mass. Super-Thumb ST4 magazine loader has no moving mechanism with a straight non-rising plunger and is designed to load 10/22 aftermarket magazines much like the loader described above, with all its weaknesses. https://www.adcosuperthumb.com/st4-extended-magazine-loader/

More advanced prior art loaders have moving mechanisms and are divided into two groups: those which are lockable in some way to the magazine, and those which the magazine sits inside the loader on an adjustable ledge, protrusion, or similar, or the magazine is just fitted in, unlocked.

TABLE 2

| U.S. patents - Loaders With Moving Mechanism - Not Lockable | | |
|---|---|---|
| Pat. or Pub. No. | Issue or Pub. Date | Patentee or Applicant |
| 4,464,855 | 1984 Aug. 14 | Musgrave |
| 4,570,371 | 1986 Feb. 18 | Mears |
| 4,689,909 | 1987 Sep. 1 | Howard |
| 4,719,715 | 1988 Jan. 19 | Howard |
| 4,888,902 | 1989 Dec. 26 | Carter |
| 5,249,386 | 1993 Oct. 5 | Switzer |
| 5,355,606 | 1994 Oct. 18 | Origoni |
| 5,377,436 | 1995 Jan. 3 | Switzer |
| 6,178,683 | 2001 Jan. 30 | Williams |
| 6,817,134 | 2004 Nov. 16, | Newman |
| 7,383,657 | 2008 Jun. 10 | Pikielny |
| 7,637,048 | 2009 Dec. 29 | Tal |
| 9,212,859 | 2015 Dec. 15 | Tal |
| D503,960 | 2005 Apr. 12 | Robert |
| 2015/0316341 | 2015 Nov. 5 | Oscar |

The above loaders have a moving mechanism for assisting loading and they are coupled to a magazine yet are not locked to it, i.e., the magazine's catch is not used. Their drawbacks are as follows: some of these loaders require adjustment to fit the magazine in prior to loading; most of them are large in size and cumbersome to operate, and the simplest ones are also cumbersome to operate; thus, no single loader is perfect in construction, operation, and comfort of loading.

Loaders with Moving Mechanism—not Lockable—Non-Patent Literature

ARCHANGEL Manufacturing/Promag Industries, South Gate, Calif., USA, makes an "Archangel 10/22 Magazine Loader AA115". It includes a flimsy push-up mechanism designed to load 10/22 aftermarket magazines. It is not lockable to the magazine and has a vertical round plunger. It sits loosely on the top of the mag making it unstable and very uncomfortable to use. https://www.archangelmanufacturing.com/aa1151022loader The following loaders have a moving mechanism and are lockable to the magazine using the magazine catch; therefore, these loaders fit a relatively narrow and selected range of magazines that have a matching magazine catch.

TABLE 3

| U.S. patents - Loaders With Moving Mechanism - Lockable | | |
|---|---|---|
| Pat. or Pub. No. | Issue or Pub. Date | Patentee or Applicant |
| 4,739,572 | 1988 Apr. 26 | Brandenburg |
| 4,939,862 | 1990 Jul. 10 | Brandenburg |
| 4,970,820 | 1990 Nov. 20 | Miller |
| 5,301,449 | 1994 Apr. 12 | Jackson |
| 8,356,441 | 2013 Jan. 22 | Meinel |
| 9,618,286 | 2017 Apr. 11 | Plate |
| 2003/0046854 | 2003 Mar. 13 | Urchek |
| 2013/0061505 | 2013 Mar. 14 | Faifer |
| 2013/0232843 | 2013 Sep. 12 | Bajuelo |
| 2014/0033592 | 2014 Feb. 6 | Fiorucci |
| 2017/0051992 | 2017 Feb. 23 | Cottrell |
| 2017/0067707 | 2017 Mar. 9 | Zivic |

The above lockable loaders have either a spring-loaded thumb or finger loading mechanism, or have a lever, shaft, or rotatable knob loading mechanism. Some include a hopper for holding rounds. Their disadvantages are listed further below.

The Faifer loader has no leverage means to ease loading, its linear spring-loaded movement is prone to friction with side thumb force, it has a fairly large housing to contain the magazine and allow long linear movement of the plunger and spring in its bore, and further it is far from suited and constructed to load Ruger's 10/22 .22LR magazines.

Further, a Speed Beez loader (aka a Lever Loader), made by Speed Beez, 13901 N. 73rd Street, Suite 207. Scottsdale Ariz., website https://www.speedbeez.com/product/glock-9mm-magazine-loader-lever-loader is a lockable loader designed to load Glock 9 mm magazines. It has a rear plunger for pushing down the top-most round into the magazine and a front pusher for pushing the round backward when the rear plunger is lifted up. The loader has an axis of rotation up and between the rear plunger and the front pusher with a scissors-like lever operating movement and a closed tunnel for dropping new rounds in. The drawbacks of this loader are numerous: its closed tunnel construction hides its internal mechanism which makes it difficult to correct malfunctions; pushing the tip of the bullet with hard plastic can form a deformation in a leaded bullet; its two-way scissors-like operation by two fingers against increasing force from the magazine' spring is uncomfortable; it has no self-rising plunging mechanism, and the loader is large and bulky.

https://www.speedbeez.com/product/glock-9 mm-magazine-loader-lever-loader/Movie clip: https://www.youtube.com/watch?v=P43nH9rgBu4

Further to the loaders listed in Table 3 above, listed below are lockable loaders which are designed specifically for the .22LR 10/22-type magazines. These include several large loaders, each with a hopper to hold fifty or so bulk .22LR rounds:

1. Champion 10/22 mag loader—http://www.championtarget.com/shooting_gear/magazines_loaders/loaders.aspx
2. McFadden Lightnin' Grip 10/22 loader—http://www.mcfaden.com/product-p/lightnin-grip.htm
3. Butler Creek Hot Lips 10/22 loader—https://www.butlercreek.com/magazine-loaders/hot-lipssteel-lips-loader
4. Ram-Line/Champion 10/22 loader—http://www.ramlinestocks.com/images/sr_40430.jpg All the lockable loaders of Table 3 and the four above are physically large, i.e., they are not pocketable. Those with a hopper have a relatively complex loading mechanisms which are known to dent delicate .22LR shells and also get stuck. Those with a curved or straight round recess are also very large and have a high-friction, inefficient loading mechanism which is also known to get stuck.

In summary, insofar as we are presently aware, all prior-art lockable loaders are large and unpocketable, are complex and difficult to operate, are unreliable in operation (they can get stuck), may dent delicate shells or tips of bullets, and/or have an open construction where the top round is not viewable and unexposed at all times for lower reliability.

Advantages

Accordingly, several advantages of one or more aspects of our loader are as follows: (a) a lockable loader provides decreased loading discomfort when loading rounds in magazines of the type having two lips which retain the topmost round, (b) a simple mechanical mechanism provides a low cost, pocket-size, lightweight loader, (c) a loader has relatively few parts, is efficient, reliable, simple, and comfortable to use, (d) a loader has an open top construction where the top-most round is viewable and exposed at all times, (e) a loader does not get stuck and does not dent delicate .22LR cal. case shells, and (f) a loader is adapted to load Ruger's 10/22-type factory magazines, and other mags of similar caliber and construction. Further advantages of one or more aspects will become apparent from a consideration of the drawings and ensuing description.

SUMMARY

The present loader facilitates loading ammunition rounds, especially relatively small caliber loose rounds like the .22LR caliber, into a firearm magazine. It basically comprises, in one aspect, a body designed to attach to a magazine with a magazine catch and a tiltable or pivotable spring-loaded press which is coupled to the body and which includes a pivotable round plunger. The body is fitted and locked to the magazine with its lock fitting in the magazine's catch hole(s) or pin(s). The press with its plunger is then pivoted down so that the plunger passes between the lips of the magazine to push the topmost round further into the magazine to create a vacant space above the topmost round. A new round can then be inserted in the magazine, rim first, until it meets the plunger. Then the user releases the press to allow it to lift and raise the plunger with the press so that the plunger is cleared from the magazine and the partially inserted round can be nudged or slid slightly further in to its final position in the magazine.

DRAWINGS

Figures

REFERENCE NUMERALS

Figure 1A:
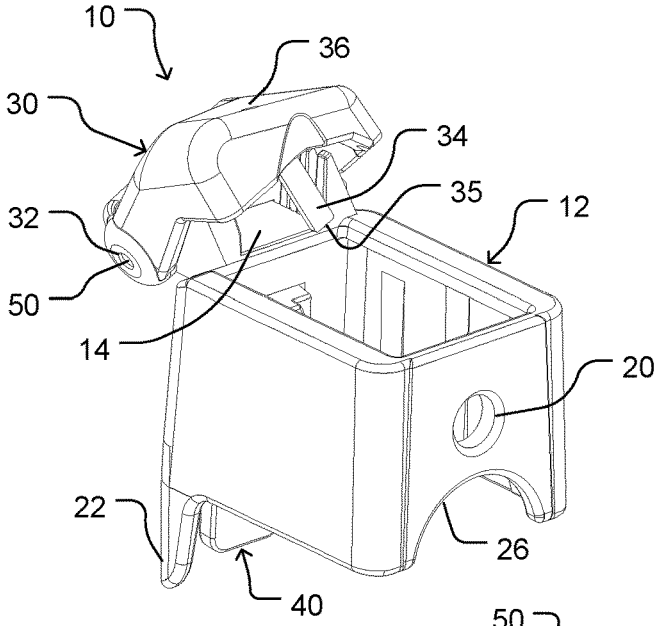
FIG. 1A is a perspective top-side view of a new magazine loader adapted to load Ruger's 10/22 .22LR factory magazines shown with its press in an 'up' position.

10 loader
12 body
14 press holder block
15 ear
16 through hole(s)
17 ledge
18 through hole(s)
20 supporting hole
22 locker protectors
24 securing hole
26 arch
28 rear opening
29 limits
30 press
32 through hole(s)
34 plunger or pusher element
35 bottom surface of plunger
36 pressing surface
37 press stop
40 locker
42 through hole
44 locker lock hole
45 slide surface
46 release surface
47 cavity
48 side stop
49 top stop
50 connecting pin
52 spring
54 connecting pin
56 spring
60 10/22 magazine

64 lips of magazine
66 front support pin
68 rear support pin
70 round of ammunition
72 shell
74 bullet
80 S&W AR15 .22LR magazine
90 Walther AR15 .22LR magazine
100 Black Dog AR15 .22LR magazine

DETAILED DESCRIPTION

Figure 1B:
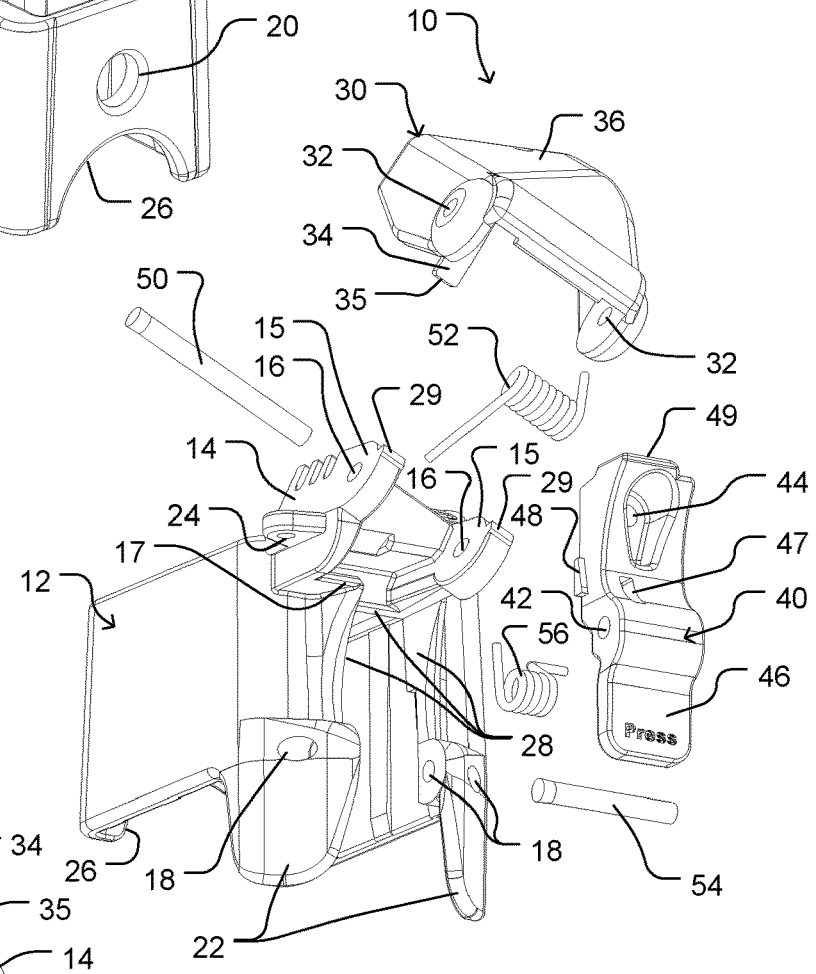
FIG. 1B is a perspective exploded rear-side view of the loader.
Figure 1C:
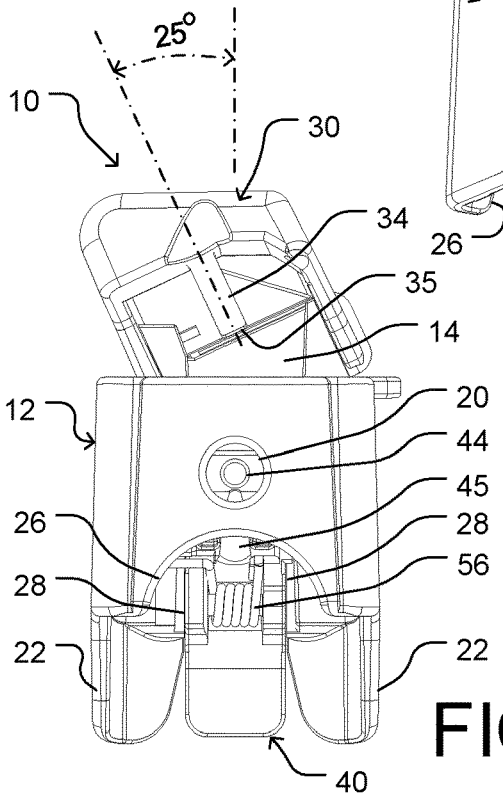
FIG. 1C is a front view of the loader.

First Embodiment—FIGS. 1A-1C

Figure 2A:
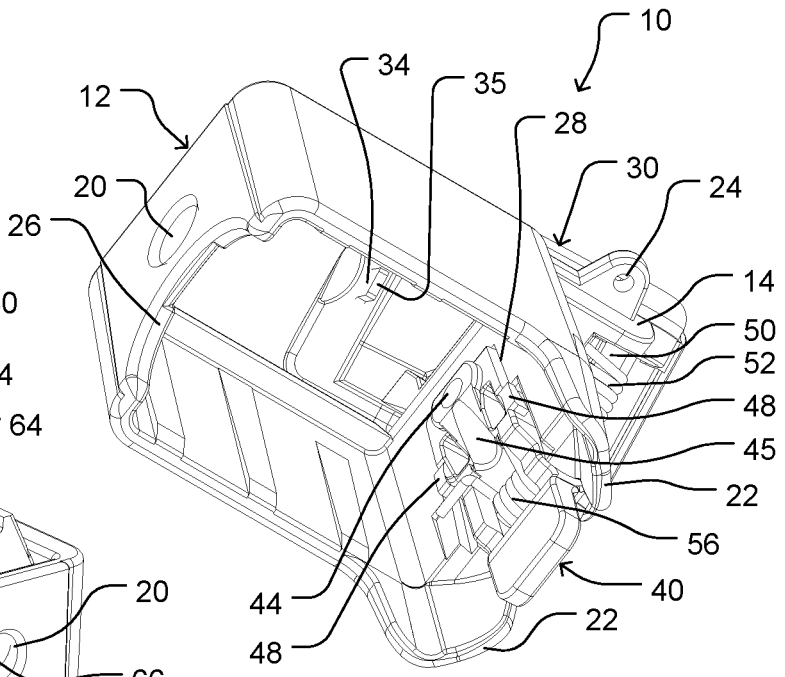
FIG. 2A is a perspective bottom view of the loader.
Figure 2B:
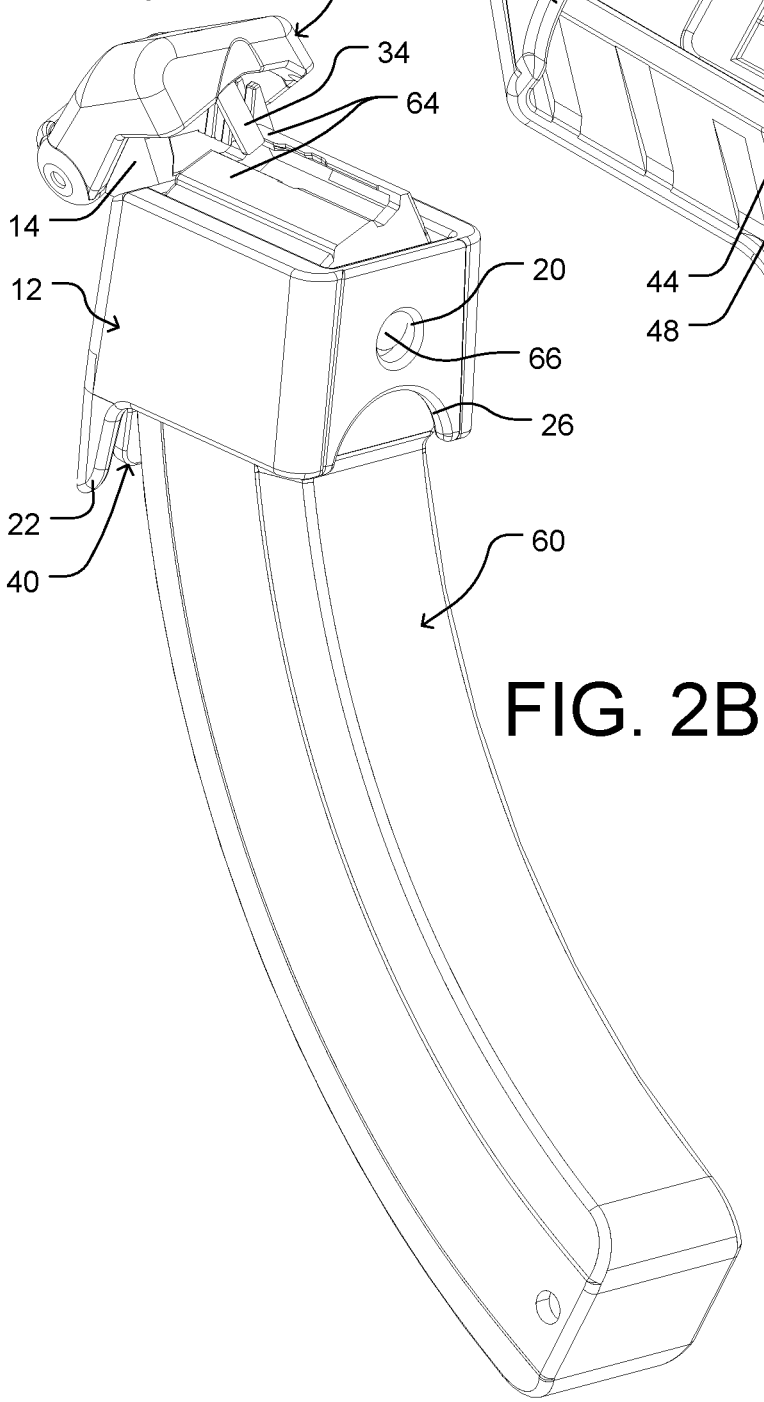
FIG. 2B is a perspective top-side view of the loader on a magazine with its press in an 'up' position.

FIG. 1A is a perspective top-side view of a first embodiment of our magazine loader 10 embodied to fit and load Ruger's 10/22 .22LR BX caliber factory magazines (FIG. 2B, 60). The loader basically comprises a hollow body or housing 12 defined by four connecting side-walls and an open bottom and top. The open bottom and the rest of the body is sized and configured to fit over the top open end, or side, of magazine 60. Magazine 60 has feed lips 64 at its top. The body has a press holder block 14 extending rearward from the top of the rear wall (not numbered) of the body and a tiltable press 30 hinge-coupled at its rear to press holder block 14. The press has a generally convex upper surface and a generally concave underside. The press also has a plunger 34 at its front side extending and angled down toward the open top of the body. Loader 10 also includes body-locking attaching or catch mating means comprising a magazine locker 40 which is coupled to the rear wall of the body below block 14 and which is designed to lock the body to a magazine catch 68 (FIG. 3C) of magazine 60. FIG. 1A further shows a supporting magazine catch hole 20 positioned centered above an arch 26 in the front wall (not numbered) of the body. A pair of lock protectors 22 extend extending down from the rear wall from the respective sides of lock 40.

FIG. 1B is an exploded view of the loader showing all its parts. Magazine locker 40 has a through hole 42 across its sides through which a pin 54 couples the locker to body 12 where pin 54 is held by and between through holes 18. Through holes 18 are distal and in line with each other and are positioned slightly rearward at the bottom side of the rear wall, where spaced shaped locker protectors 22 extend downward.

Pin 54 also passes through a torsion spring 56 encompassed by the locker (FIG. 4D) having one arm positioned at a small cavity 47 inside locker 40 and a second arm bent sideward and resting at an inner side of the rear wall (FIG. 2A). Thus locker 40 is pre-tensioned by the spring against the body. Locker 40 further includes a magazine catch lock hole 44 centered at its upper part and a release surface 46 at its lower part and a protruding top stopper 49 at its top and a protruding side stop 48 at each side of the locker above hole 42, as seen also in FIG. 4D. Stopper 49 engages an outer horizontal top of a predominantly rectangular vertical opening 28 in the rear wall of the body below press holder 14, thereby limiting the locker to parallel the rear wall. Locker 40 is tensioned by spring 56 against the body when the loader is not installed on the magazine. Side stops 48 of the locker are designed to limit the outer tilting angle (shown in FIG. 3D) of the locker by engaging the inner sides of opening 28 in the rear wall. Hence, locker 40 is tiltable outward (about 13°), as limited by stops 48 when force is applied to release surface 46.

Shaped tiltable press 30 is positioned over press holder 14, somewhat encompassing it, and partly over the open top side of the body. The press is hinge-coupled at its lower or rear side to press holder 14 of the body by pin 50. Pin 50 provides an axis of rotation, which is held at both ends by distal and inline through holes 32 in respective ears portions at the back and at opposite sides of the press. Pin 50 passes through holes 16 in ears 15 of press holder 14. A torsion spring 52 encompasses pin 50 and has an upper arm positioned at a bottom or inner side of press 30 (FIG. 4A) and a lower arm positioned on ledge 17 (FIG. 4B) extending backward from the rear wall. Thus press 30 is tensioned and angled upward from the body by spring 52. A protruding limit 29 each at the rear rounded outskirt of ears 15 of press holder 14 (FIGS. 4B and 4C) engages press stops 37 (FIG. 4A) at the inner side of press 30 to limit the upward angle of the press above the body. Press 30 further has a flat press surface 36 that the user will press to insert a new round. FIG. 1A to 1C plunger or pusher element 34, which is a generally flat metal member that extends and is angled downward from the forward portion of the generally concave inner side of press 30 and which has a predominantly flat bottom edge 35. As shown, the top of press 30 is generally convex.

Note that Ruger's 10/22 .22LR factory magazines have a substantially unique lip construction which requires an angled push to load a new round. Plunger 34 is thus angled at 25° counterclockwise from vertical in this first embodiment, as seen in FIG. 1C looking from the front of the loader. The loader elements, press 30, hinge pin 50, spring 52, ears 15 of press holder block 14, holes 16 and 32, limits 29, and stops 37, are all angled and configured accordingly to orient the plunger to tilt along the 25° line from vertical. Body 12 has a pair of generally parallel connecting sides joining the front and rear sides. Thus the plunger or tooth, when viewed from the front side of said body, is tilted at an acute angle of 25° from the connecting sides. Thus, hinge pin 50 is angled 90° from the plunger to allow the press and plunger to translate along the 25° line from vertical when the press is pressed to angle down and released.

The loader's body, press, and locker are preferably made of durable glass-fibered polymer material, such as polyamide-6, and is preferably produced by plastic injection molding. The springs are preferably made of spring wire material and the pins and plunger are made of metal for strength. Plunger 34 is flat and substantially thin, being molded over during the plastic injection process; its width is slightly less than the distance between lips 64 of the magazine, enabling it to pass between them when the press is pushed down (FIG. 3B).

Figure 2C:
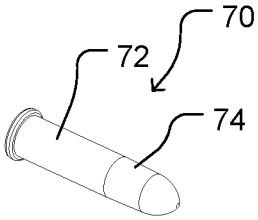
FIG. 2C show a .22LR caliber round.

FIGS. 2A-2C—Perspective Views

FIG. 2A is a perspective bottom view of the loader showing locker 40 positioned inside opening 28 in the rear wall of the body. Locker spring 56 is partly enclosed by a depression in the locker (FIG. 4D) with its left arm (as shown) formed to rest on the inner side of the rear wall. Locker 40 has a smooth inclined slide surface portion 45 below and leading to hole 44 (FIG. 4D). Also, partly shown in FIG. 2A is spring 52 for holding hinge pin 50 in place and a securing hole 24 which extends from the side of press holder 14 and to which a securing cord (not shown) can be tied.

FIG. 2B is a perspective side view of the loader locked in place on a Ruger 10/22 BX-25 factory magazine 60. This magazine and the like have two in-line projecting magazine catch pins; pin 68 is positioned at rear side and a larger-diameter pin 66 is positioned at the front side of the upper part of the magazine. Rear pin 68, as partly illustrated in FIG. 3C, is fitted in locking hole 44 of the locker. Magazine 60 further has two lips 64 at its top upper end for holding a .22LR round in place. Pin 66 of the magazine fits in support hole 20 at the front wall of body 12 and pin 68 fits in hole 44 of locker 40 when the loader is installed on the magazine, thereby securely locking the loader to the magazine.

FIG. 2C show a .22LR round 70 comprising a shell 72 and bullet 74 coupled to the shell.

FIGS. 3A-3D—Perspective Views

Figure 3A:
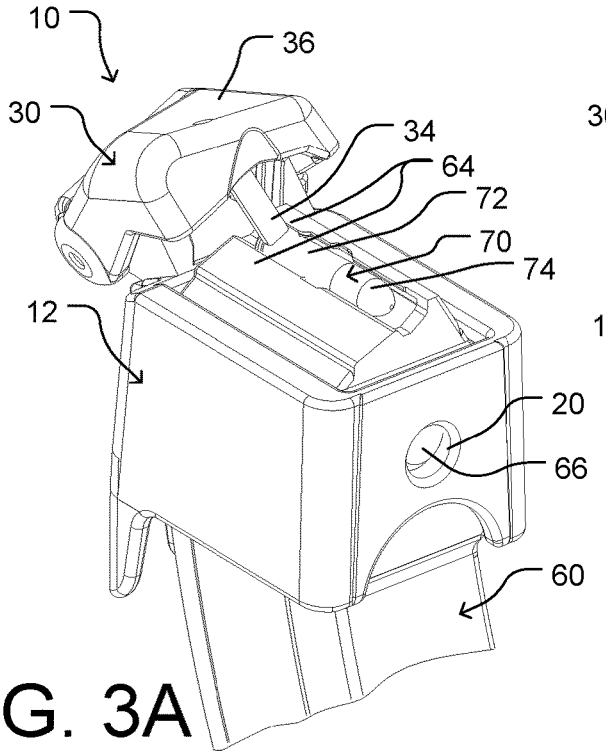
FIG. 3A is a perspective top-side view of the loader on the magazine holding a round, press up.
Figure 3B:
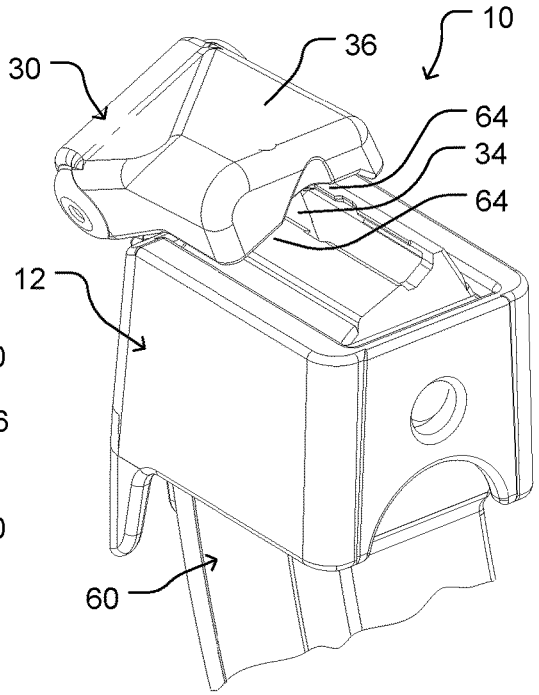
FIG. 3B is a perspective top-side view of the loader on the magazine, press down.
Figure 3C:
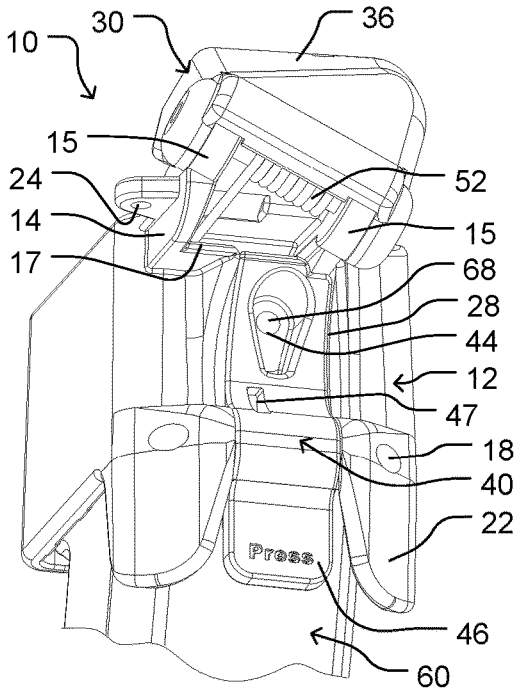
FIG. 3C is a perspective rear view of the loader on the magazine.

FIG. 3A is a perspective view of the loader fitted and locked to a magazine 60, which is shown with a top round 70 held by lips 64 engaging shell 72 of the round. The round is shown positioned at its final rear position in the magazine. Press 30 is shown at its uppermost angled position (as in FIG. 1C) with the lower end surface 35 (not shown) of plunger 34 clear above and slightly to the left of shell 72. Plunger 34 is angled 25° from the vertical. The magazine's front securing pin 66 sits in and supported by hole 20 in the front wall of body 12.

FIG. 3B is a perspective view of the loader locked to the magazine with press 30 in its downmost position. Plunger 34 has traveled down along the 25° angle line with bottom edge 35 (hidden) engaging shell 72 of round 70 (or the follower if no round has already been loaded). Thus plunger 34 pushes the round and/or follower down in the magazine so as to form a vacant space above the round and below lips 64. Again, the inner construction of the Ruger 10/22 0.22LR factory magazine requires that plunger 34 move down at the 25° angle between the lips. Other orientations of plunger 34 may be used, from 0° to any acute angle of 25° and more, but our tests show the 25° angle operates for both drum and column BX magazines.

FIG. 3C is a perspective rear view of the loader locked to the magazine and showing a portion of the magazine's rear lock pin 68 in hole 44 of locker 40. Locker 40 is shown in opening 28 in the rear wall of the body.

Figure 3D:
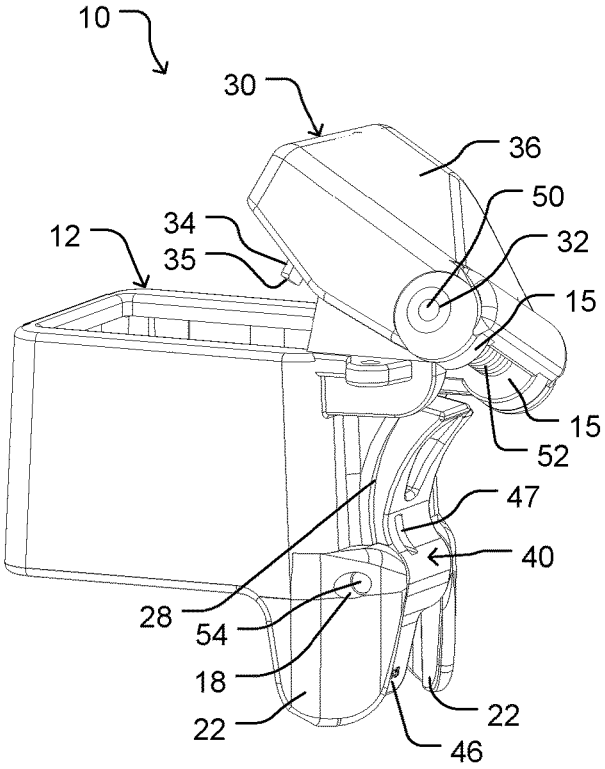
FIG. 3D is a perspective rear-side view of the loader with its lock tilted backward.

FIG. 3D shows the lower portion of locker 40 depressed inward at its release surface 46, thereby tilting hole 44 outward (not shown) to disengage from rear support pin 68 of the magazine. This allows the magazine to be released downward from the loader. Locker protector fins 22 are rearwardly and downwardly shaped to isolate the locker sufficiently from accidental finger(s) pressure when the user encompass the loader during holding and loading.

FIGS. 4A-4D—Perspective Views

Figure 4A:
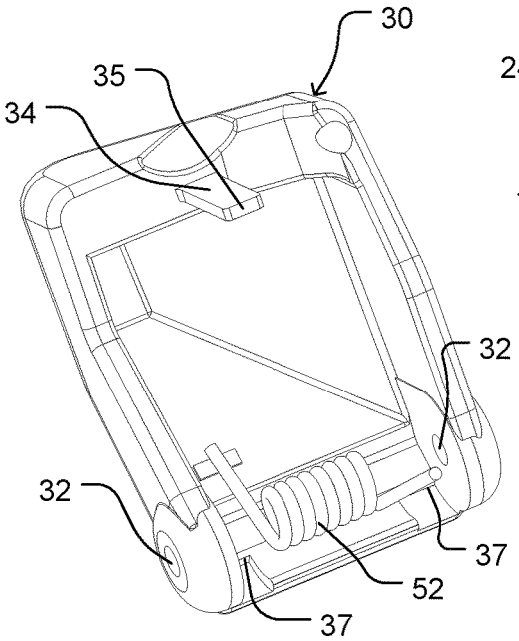
FIG. 4A is a perspective bottom view of the press.

FIG. 4A shows a bottom view of press 30, visible bottom surface 35 of the plunger, and the left arm of spring 52 positioned on a small rectangular protrusion (not numbered) at the inner underside of the press. Also shown are press stop ridges or ledges 37, which each interact with limits 29 (illustrated in FIG. 4B). Press 30 is geometrically shaped with few ornamental features (not numbered) so that it is both aesthetic and functional.

Figure 4B:
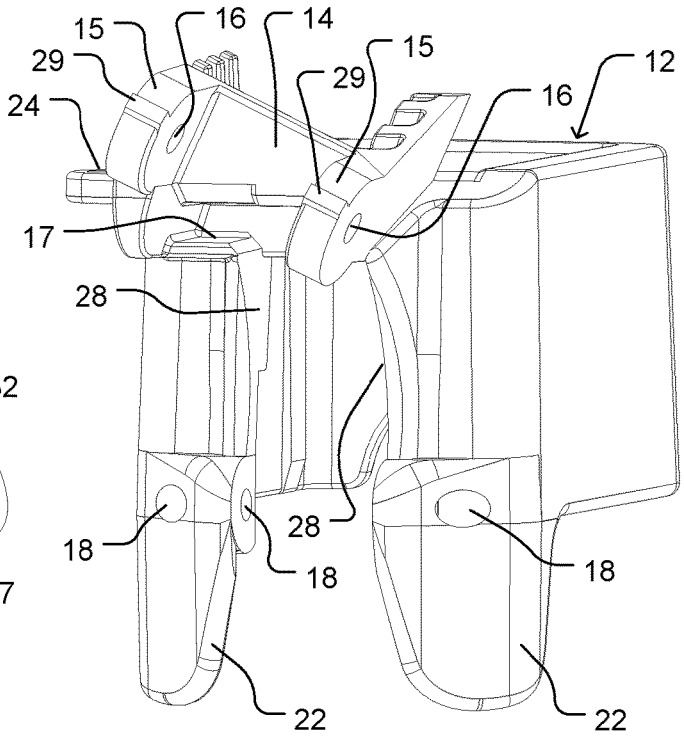
FIG. 4B is a perspective rear view of the body.
Figure 4D:
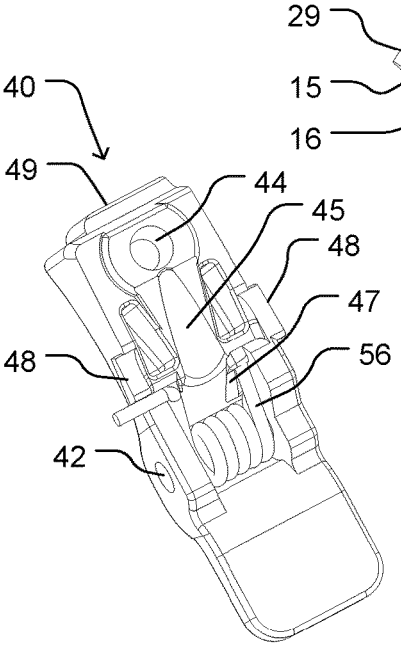
FIG. 4D is a perspective inner view of the lock.

FIG. 4B is a rear view of the body showing press holder block 14 extending rearward with its projecting 25° angled ears 15, as well as predominantly rectangular vertical opening 28 in the rear wall for receiving the locker (not shown).

Figure 4C:
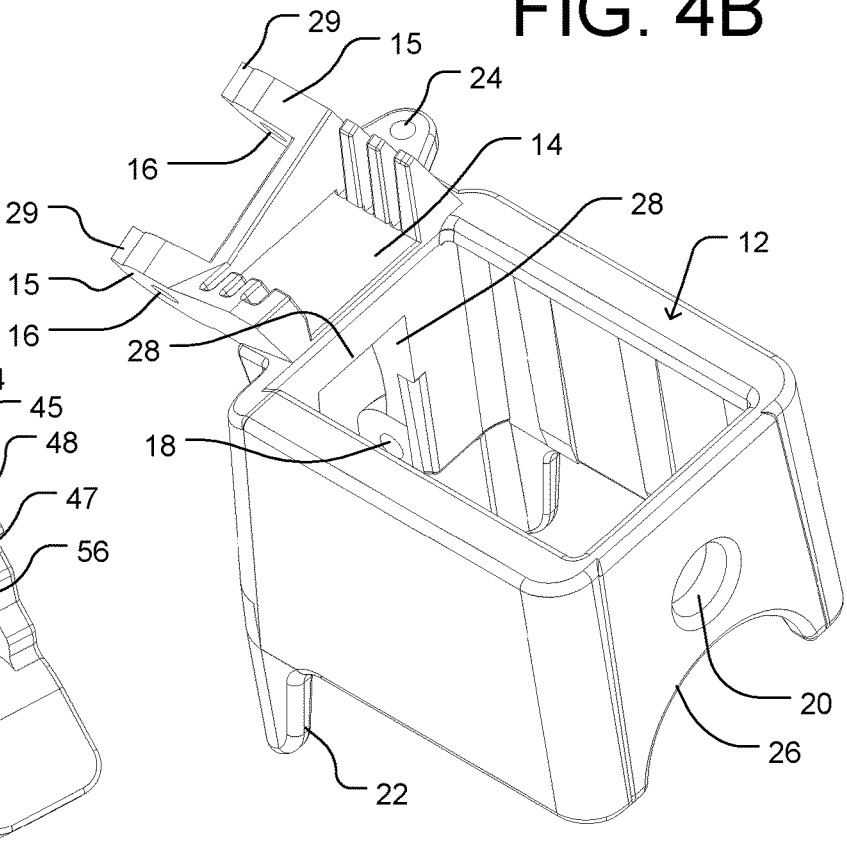
FIG. 4C is a perspective upper view of the body.

FIG. 4C is a top-front view of the body and also showing press holder block 14 extending rearward. Block 14 has various constructional strengthening elements and ribs (not numbered) designed to stabilize the press at movement.

FIG. 4D shows locker 40 with its top stop 49, side stops 48, locker hole 44, slide surface 45, and spring 56, as well as other referenced features.

Operation—FIGS. 3A-3D

To use the loader to load rounds into a magazine without requiring fatiguing repetitive finger force, the user first fits loader 10 (FIG. 1) onto magazine 60 (FIG. 2B) from above. The magazine's front pin 66 enters hole 20 while its rear pin 68 slides upward along inner slide surface 45 of locker 40 (FIGS. 2A and 4D). This increasingly pushes the upper part of locker 40 backward against the force of spring 56 until pin 68 enters hole 44 of the locker and clicks into place.

Once the loader is fitted and locked by the front and rear pins of the magazine, the user presses press surface 36 to force the press from an up or top position angled relatively widely from the top of hollow body 12 to an angled down or lower or closed position relatively close to hollow body 12. The user holds this position (FIG. 3B). Thus, the press has angled down in two ways: it has angled down from its hinge or pivot line around pin 50 (looking from the side of the loader), and it has also angled down, including plunger 34, along the 25° line (looking from the front of the loader).

Hence plunger 34 has traveled between lips 64 of the magazine and has pushed in, with its bottom surface, the magazine's follower or rotated an internal drum, if any, (both not shown), or has pushed in a topmost round and all rounds below or next to it, if any, further into the magazine. Hence, a vacant space is formed below lips 64 and above the follower or topmost round, thus completing the first stage of the loading.

The user then slides a new round 70 rearward into the vacant space, case 72 first, until the case meets or hits plunger 34 inside the magazine (not shown), thus completing the second stage of loading.

While case 72 of the round is partially below lips 64, the user releases pressure on press surface 36, allowing press 30 and its plunger 34 to rise up (due to the force from spring 52), clearing the plunger from the magazine. The magazine's internal spring (not shown) and follower or drum (not shown) push up (or rotate the round(s) in a drum magazine) until the case of the newly inserted round engages the magazine lips from the bottom and holds, completing the third stage of loading.

The user can now easily push or nudge the newly and partially inserted round with a finger fully rearward into the magazine along the underside of the lips to its final rear position below the lips, as shown in FIG. 3A, hence completing the fourth and last stage of loading.

The user repeats this loading process (force press down, partially insert a new round, release pressure on the press, slide the round fully rearward) until the magazine is full. Use of the loader eliminates the need to use fatiguing or increasing finger force to push the follower and any rounds above it down.

Releasing the loader from the magazine is simply done by simultaneously (1) pressing the locker's release surface 46 with a thumb, so that hole 44 clears rearward from rear pin 68, while (2) pushing the locker up with the thumb away from the magazine, or by pushing release surface 46 and moving the loader backward to release pin 66 from hole 20, and then pulling the loader up.

Locking the loader on the magazine and using the spring-loaded press element provides great benefits by allowing the user, for example, to hold the magazine and loader in one hand, free from external support, while comfortably feeding rounds with the other hand. In this embodiment, loading the Ruger's 10/22 .22LR caliber magazine is quicker, smoother, and more comfortable than using all prior-art loaders designed to load such magazines of which we are aware. Further, the loader described is extremely reliable in operation as it is virtually impossible to have rounds or loader get stuck while loading, unlike most prior-art loaders. Still further, the loader is lightweight, pocketable, very durable, and possibly the smallest of all known 10/22 magazine loaders.

The loader is designed to be compatible with Ruger's 10/22 factory .22LR caliber BX drum and high-capacity magazines. The range and types of magazines and round calibers may be extended or altered by changing the dimensions, arrangement, plunger angle, plunger tip, and configuration of the loader parts. For example, the loader can be easily designed to have a vertically moving press and plunger (not a 25° movement) to enable loading other commercially available 10/22-type .22LR magazines with somewhat different lips and inner lips construction, made by host of manufacturers. Further, the loader can be altered under the methods and principles here described to load 0.177, 0.25, 0.32, 0.380, 9 mm, 10 mm, 0.357, and .45 caliber magazine and others, though it is more comfortable to use with smaller caliber magazines and rounds.

Figures 5A, 5B, 5C:
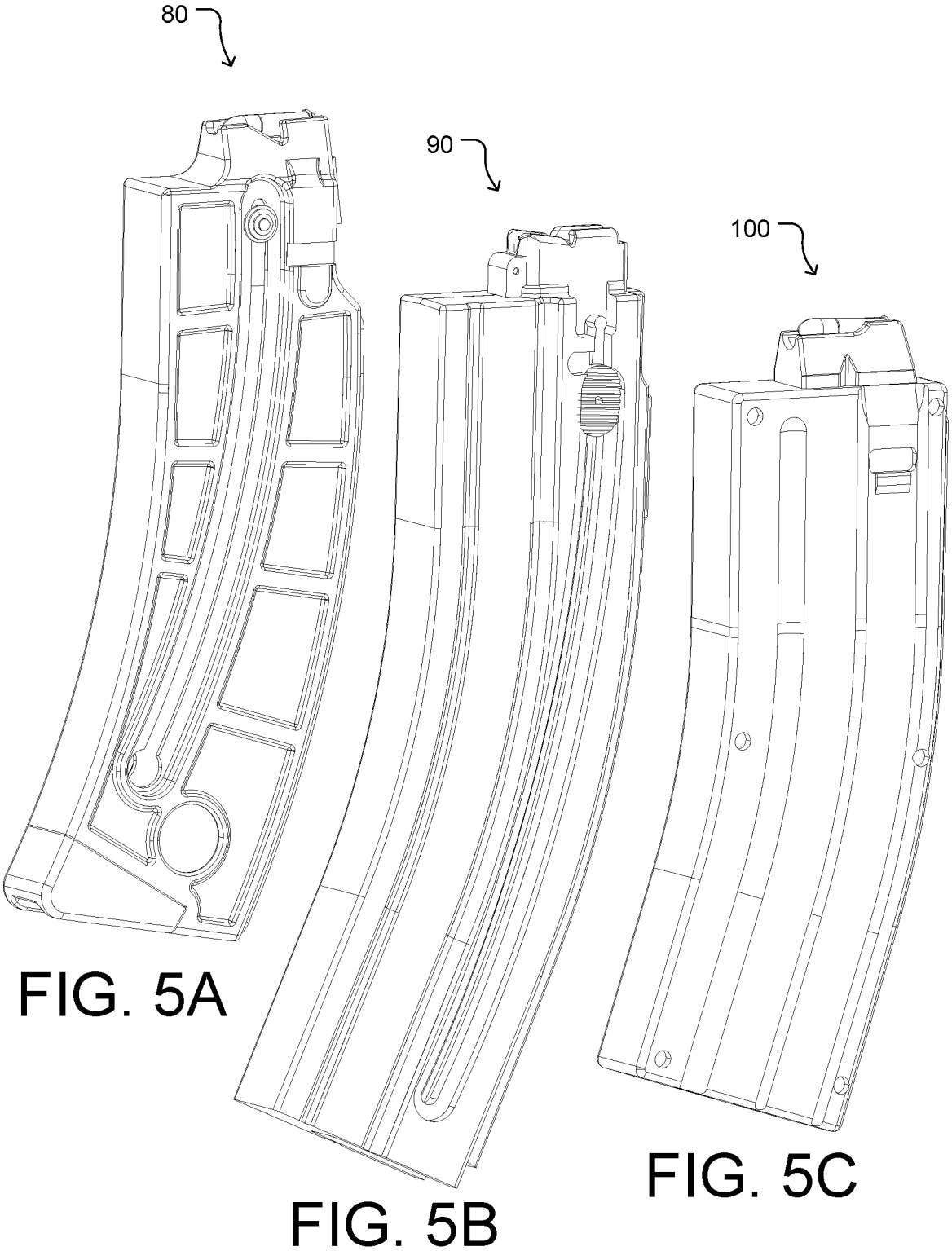
FIG. 5A-5C are perspective views of the following magazines: a S&W AR .22LR, a Walther AR .22LR, and a BlackDog AR .22LR, respectively.

Additional Embodiments—FIGS. 5A to 5C

One or more additional embodiment(s) of the present loader can be provided to load AR15-type .22LR converted magazines, such as the S&W M&P magazine 80 (FIG. 5A), the Walther magazine 90 (FIG. 5B), or the Black Dog magazine 100 (FIG. 5C). These magazines have a magazine catch on a side-wall of the magazine and lock 40 is altered. Loaders for such magazines have a body 12 is adapted to lock on this catch. Further press holder block 14, press 30, plunger 34, and all associated components and construction are designed so that the plunger tilts vertically above and between the lips of a magazine, rather than the 25° angle as described in the first embodiment above.

CONCLUSION, RAMIFICATIONS, AND SCOPE

The reader will see that we have provided a magazine loader which is locked to the magazine for comfortable operation and has a friendly self-rising round's plunger. The user can load multiple magazines without any thumb pain associated with directly pushing a new round into the magazine. The loader comprising few parts is highly reliable, comfortable to use, palm-size, light weight, and easy to operate. Further, the predominantly open and exposed space above the magazine and lips permits flawless and smooth loading sequence whereby the user can see all parts involved in the loading process at all times.

While the above description contains many specificities, these should not be construed as limitation on the scope but rather as an exemplification of several embodiments thereof. Other ramifications and variations are possible within the teachings. For example, the loader(s) described can be altered to fit other magazines and calibers provided a suitable change in dimensions and construction is made in the loader to suit a magazine. E.g., a loader can be altered to load almost all pistol magazines as well as other 10/22 type magazines and a variety of predominantly .22LR AR15-style converted magazines. Further, a loader can be altered to fit and load virtually all other magazines on the market holding a single round between and by both magazine lips.

The following are further examples of some additional variations and ramifications:

The loader body may be adapted to lock on AR15 .22LR caliber magazines where the mag catch is on a side of the magazine. There may be made several different bodies all adaptable to connect to a single upper loading mechanism whereby a user can buy one loading mechanism and several different bodies alternating the loader part between the body parts by attachment according to needs.

The geometry and design of the plunger and/or its tip may change to be operate best with this and other loader designs.

The loader and its components may be made of separate and or different plastic materials, or, alternatively, of other materials, such as aluminum or steel, and any combination thereof.

All numerical values provided are approximate; they can be changed to adapt to other magazines or round types and or calibers.

The loader may also be constructed to include insertable or movable spacer(s) to accommodate magazines of different dimensions and or geometries.

Various other spring types or other mechanical means or methods may replace the torsion springs mentioned; such can be an extension spring, a compression spring, conical spring, a flat steel spring, flexible rubber, or a flexible polymer spring member.

Accordingly, the scope should be determined, not by the embodiments illustrated, but by the appended claims and their legal equivalents.

The invention claimed is:

1. A magazine loader for facilitating the loading of rounds into a predetermined firearm magazine having an open upper end and which may hold rounds therein and urges said rounds to, and feeds said rounds from, said open end of said magazine, said magazine having a spring-urged follower for pushing any rounds in said magazine that are above said follower to said open end of said magazine, said magazine further having at least one magazine catch, said loader comprising:

a body or holder comprising a hollow body that has an opening at its bottom that is sized and shaped to fit onto said open upper end of said magazine, said body or holder having a front side and a rear side, body-locking or attaching means hingely coupled to said body or holder for removably attaching said body to said catch of magazine, a manually operable press that is hinge-coupled to said rear side of said hollow body and extends generally above said body, said press having an up position where it is angled relatively far from said body and a down position where it can be pivoted to be relatively close to said body, spring means for normally urging said press to said up position where it is angled relatively far from said body, said press having a plunger or tooth which extends therefrom and which has a top end attached to said press and a free bottom end, said press and said free bottom end of said plunger being shaped so that, when said body is fitted and locked by said body-locking means to said magazine, said free bottom end is positioned above said open end of said magazine when said press is in said up position and positioned in said open end of said magazine when said press is in said down position, such that (a) when said press is manually pivoted from said up position to said down position, said free open end of said plunger will engage and push down said follower and any rounds above said follower in said magazine a sufficient distance to make space for partly insertion of a new round into said magazine above a topmost round or said follower, and (b) when said press is released, said spring means will force said press to return to its up position where said plunger is positioned above said open end of said magazine and said round can be pushed to a fully inserted position in said magazine.

2. The magazine loader of claim 1 wherein said bottom opening of said body or holder has a substantially rectangular shape so as to be fittable on a magazine that has a substantially rectangular open end.

3. The magazine loader of claim 1 wherein said body-locking or attaching means comprises a pivotable member or locker positioned on a side of said body or holder, said pivotable member or locker having a hole therein.

4. The magazine loader of claim 3 wherein said pivotable member or locker (a) is pivotably attached to said body at a substantially middle portion of said pivotable member or locker, (b) has said hole therein on an upper side of said pivotable member or locker, and (c) has a spring for urging said upper side of said upper portion against said body.

5. The magazine loader of claim 1 wherein said press has a generally convex top surface and a generally concave underside, and said plunger or tooth extends from said underside, said hinge coupling being positioned at an opposite end of said press from said plunger or tooth.

6. The magazine loader of claim 1 wherein said hinge coupling of said press comprises a pair of ear portions with a respective pair of pivot holes and wherein said body has a press holder block or portion that extends from said rear side of said body and that has a pair of ear portions with a respective pair of pivot holes arranged to be alignable with said holes of said press, and further including a pivot pin inserted through said holes of said press holder and said press to as to pivotably connect said press with said press holder block or portion.

7. The magazine loader of claim 6 wherein said spring means comprises a coil spring around said pivot pin.

8. The magazine loader of claim 1 wherein said body has a pair of generally parallel connecting sides joining said front and rear sides and wherein said plunger or tooth, when viewed from the front side of said body, is tilted at an acute angle greater than zero degrees from said connecting sides.

9. The magazine loader of claim 1 wherein said body-locking or attaching means comprises a first hole on one side of said body or holder and a pivotable member or locker on an opposite side of said body or holder and having a second hole therein and wherein said hinge coupling of said press comprises a pair of ear portions with a respective pair of pivot holes and wherein said body has a press holder block or portion that extends from said rear side of said body and that has a pair of ear portions with a respective pair of pivot holes arranged to be alignable with said holes of said press so that a pivot pin can be inserted through said holes of said press holder and said press to as to pivotably connect said press with said press holder portion.

10. The magazine loader of claim 1 wherein said press has a generally convex top surface and a generally concave underside, and said plunger or tooth extends from said underside, said hinge coupling being positioned at an opposite end of said press from said plunger or tooth, and wherein said hinge coupling of said press comprises a pair of ear portions with a respective pair of pivot holes and wherein said body has a press holder block or portion that extends from said rear side of said body and that has a pair of ear portions with a respective pair of pivot holes arranged to be alignable with said holes of said press, and further including a pivot pin inserted through said holes of said press holder and said press to as to pivotably connect said press with said press holder portion.

11. A magazine loader for loading a firearm magazine having (1) an open end containing rounds feed lips, (2) a spring-urged follower for urging rounds in said magazine to said feed lips at said open end, and (3) a magazine catch, comprising:

(a) a hollow body having a top and a bottom with an opening at said bottom, said opening being sized and shaped to fit onto said open end of said magazine, (b) body-locking or attaching means coupled to said hollow body for removably attaching said body to said magazine catch, (c) a press pivotably attached to said hollow body at said top thereof, (d) said press arranged to be pivotable from a up or open position angled relatively wide from said top of said hollow body to a down or closed position relatively close to said top of said hollow body, (e) a spring for normally urging said press to said up position, (f) said press having a plunger or tooth extending therefrom which has a top end attached to said press and a free bottom end, (g) said plunger or tooth shaped and positioned so that (1) when said press is manually moved from said up position to said down position, it will force said follower, or said follower and any rounds above said follower, down a sufficient distance to make space to enable a new round to be partly inserted into said magazine above a topmost round or said follower and below said feed lips, and (2) when said press is released, said spring will force said press to return to its up position where said plunger is positioned above said open end of said magazine and said round can be pushed to a fully inserted position in said magazine.

12. The magazine loader of claim 11 wherein said opening at said bottom of said hollow body has a substantially rectangular shape so that it can be fitted on a firearm magazine that has a substantially rectangular shape.

13. The magazine loader of claim 11 wherein said hollow body has at least one side extending from said top to said bottom thereof and said body-locking or attaching means of said hollow body comprises a pivotable member or locker attached to said one side of said housing.

14. The magazine loader of claim 13 wherein said pivotable member or locker has upper and lower portions, a hinge between said upper and lower portions, and a spring for urging said upper portion against said one side of said body.

15. The magazine loader of claim 11 wherein said press has a generally convex top surface and a generally concave underside, and said plunger or tooth extends from one end of said underside, said press having a hinge coupling positioned at an opposite end of said underside from said plunger or tooth for enabling said press to be pivotable.

16. The magazine loader of claim 11 wherein said press has a pair of ear portions with a respective pair of pivot holes and wherein said hollow body has a holder block or portion that extends from a side of said top of hollow body and that has a pair of ear portions with a respective pair of pivot holes arranged to be alignable with said pivot holes of said press, and further including a pivot pin inserted through said pivot holes of said ear portions and said press to pivotably connect said press with said housing holder block or portion.

17. The magazine loader of claim 16 wherein said spring comprises a coil spring around said pivot pin.

18. The magazine loader of claim 11 wherein said hollow body has four sides connecting said top and bottom, including first and second pairs of opposing sides joined to form a rectangular configuration, said press being attached to one of said sides of said first pair of sides, and wherein said plunger or tooth, when viewed toward the other of said first pair of sides, is tilted at an acute angle greater than zero degrees from said second pair of sides.

19. The magazine loader of claim 11 wherein (a) said hollow body has at least one pair of sides connecting said top with said bottom and (b) said locking or attaching means for removably attaching said hollow body to said magazine comprises a first hole on one of said pair of sides and a pivotable member or locker on an opposite one of said pair of sides, said pivotable member having a second hole therein, and wherein said press has a pair of ear portions with a respective pair of pivot holes and said hollow body has a housing holder block or portion that extends from a side of said hollow body and that has a pair of ear portions with a respective pair of pivot holes arranged to be alignable with said holes of said press so that a pivot pin can be inserted through said holes of said housing holder and said press to as to pivotably connect said press with said housing holder block or portion.

20. The magazine loader of claim 11 wherein said press has a generally convex top surface and a generally concave underside, and said plunger or tooth extends from one end of said underside, said press is pivotably attached to said hollow body by a hinge coupling positioned at an opposite end of said underside from said plunger or tooth, said hinge coupling comprising a pair of ear portions with a respective pair of pivot holes and wherein said hollow body has a housing holder block or portion that extends from said rear side of said hollow body and that has a pair of ear portions with a respective pair of pivot holes arranged to be alignable with said holes of said press, and further including a pivot pin inserted through said holes of said housing holder block or portion so as to as to pivotably connect said press with said housing holder block or portion.

* * * * *